US011519207B2

(12) United States Patent
Liu et al.

(10) Patent No.: US 11,519,207 B2
(45) Date of Patent: Dec. 6, 2022

(54) REFRIGERATION DEVICE

(71) Applicant: BSH Hausgeraete GmbH, Munich (DE)

(72) Inventors: Qinchao Liu, Nanjing (CN); Ping Lv, Nanjing (CN); Alfred Raab, Huettlingen (DE); Chuan Zhang, Chuzhou (CN)

(73) Assignee: BSH HAUSGERAETE GMBH, Munich (DE)

( * ) Notice: Subject to any disclaimer, the term of this patent is extended or adjusted under 35 U.S.C. 154(b) by 755 days.

(21) Appl. No.: 16/508,359

(22) Filed: Jul. 11, 2019

(65) Prior Publication Data

US 2020/0024880 A1 Jan. 23, 2020

(30) Foreign Application Priority Data

Jul. 18, 2018 (CN) ..... 201810794896.3

(51) Int. Cl.
*E05D 3/12* (2006.01)
*F25D 23/02* (2006.01)
(Continued)

(52) U.S. Cl.
CPC ..... *E05D 3/12* (2013.01); *E05D 5/0276* (2013.01); *E05D 7/0027* (2013.01); *E05D 11/06* (2013.01);
(Continued)

(58) Field of Classification Search
CPC ..... E05D 3/12; E05D 5/0276; E05D 7/0027; E05D 11/06; E06B 5/00; F25D 23/028;
(Continued)

(56) References Cited

U.S. PATENT DOCUMENTS 8,388,078 B2 * 3/2013 Kwon ..... F25D 23/025 312/405
9,448,004 B2 * 9/2016 Kim ..... F25D 23/025
(Continued)

FOREIGN PATENT DOCUMENTS

CN 103423937 A 12/2013
CN 103836873 A 6/2014
(Continued)

*Primary Examiner* — Hanh V Tran
(74) *Attorney, Agent, or Firm* — Laurence A. Greenberg; Werner H. Stemer; Ralph E. Locher

(57) ABSTRACT

A refrigeration device has a first door with an opening and a second door for closing the opening in the first door. A first hinge member has a first connection portion fixed on a main body of the refrigeration device and a first hinged portion connected to the first door. A second hinge member has a second connection portion fixed on the first door and a second hinged portion connected to the second door. The second hinge member includes a columnar portion that is hinged to the first hinged portion. One of the columnar portion and the first hinged portion has a first shaft hole, and the other one has a first hinge shaft that extends into the first shaft hole. The novel device prevents a door body of the refrigeration device from being damaged at a hinged position and the reliability of the refrigeration device is improved.

17 Claims, 12 Drawing Sheets

(51) Int. Cl.

| | |
|---|---|
| ***E06B 5/00*** | (2006.01) |
| ***E05D 7/00*** | (2006.01) |
| ***E05D 11/06*** | (2006.01) |
| ***E05D 5/02*** | (2006.01) |

(52) U.S. Cl.
CPC ..... *E06B 5/00* (2013.01); *F25D 23/028* (2013.01); *F25D 2323/021* (2013.01); *F25D 2323/024* (2013.01)

(58) Field of Classification Search
CPC ..... F25D 2323/021; F25D 2323/024; F25D 11/00; F25D 23/02; E05Y 2900/302; E05Y 2900/31
See application file for complete search history.

(56) References Cited

U.S. PATENT DOCUMENTS

| | | | | |
|---|---|---|---|---|
| 10,260,261 | B2 * | 4/2019 | Reuter | E05D 7/0415 |
| 10,451,332 | B2 | 10/2019 | Yi | |
| 10,458,164 | B2 * | 10/2019 | Wantland | E05F 1/043 |
| 10,524,586 | B2 * | 1/2020 | Oh | E05D 11/0081 |
| 10,544,983 | B2 * | 1/2020 | Lee | F25D 29/005 |
| 11,002,048 | B2 * | 5/2021 | Nakamura | F16C 11/04 |
| 2011/0023527 | A1 * | 2/2011 | Kwon | F25D 23/02 62/449 |
| 2011/0023528 | A1 * | 2/2011 | Kwon | F25D 23/028 62/449 |
| 2013/0026900 | A1 * | 1/2013 | Oh | E05B 65/0042 312/401 |
| 2014/0132144 | A1 * | 5/2014 | Kim | E05D 11/0081 312/405 |
| 2014/0232251 | A1 * | 8/2014 | Kim | F25D 23/025 312/405 |
| 2015/0233629 | A1 * | 8/2015 | Choi | F25D 23/04 312/405 |
| 2015/0260447 | A1 * | 9/2015 | Kim | G08B 5/36 312/405 |
| 2016/0252291 | A1 * | 9/2016 | Kikuchi | F25D 23/028 312/405 |
| 2017/0176089 | A1 * | 6/2017 | Ramm | E05D 7/0027 |
| 2017/0188721 | A1 * | 7/2017 | Park | G02B 27/144 |
| 2017/0211304 | A1 * | 7/2017 | Fang | E05D 7/081 |
| 2017/0356685 | A1 * | 12/2017 | Jung | E05D 7/00 |
| 2018/0149409 | A1 * | 5/2018 | Ramm | E05D 15/00 |

FOREIGN PATENT DOCUMENTS

| | | | |
|---|---|---|---|
| CN | 104236219 | A | 12/2014 |
| CN | 105074368 | A | 11/2015 |
| CN | 105546912 | A | 5/2016 |
| CN | 107148545 | A | 9/2017 |
| CN | 207092786 | A | 3/2018 |

* cited by examiner

REFRIGERATION DEVICE

CROSS-REFERENCE TO RELATED APPLICATION

This application claims the priority, under 35 U.S.C. § 119, of Chinese application CN 201810794896.3, filed Jul. 18, 2018; the prior application is herewith incorporated by reference in its entirety.

BACKGROUND

Technical Field

The present invention relates to the field of refrigeration device technologies, and specifically, to a refrigeration device.

Related Art

With popularization of refrigeration devices in people's daily life, more and more people start to use the refrigeration devices such as refrigerators to store perishable food such as vegetables and fish and meat.

A refrigerator is used as an example. As one of important components of the refrigerator, a hinge achieves an effect of connecting a door of the refrigerator and a box body. The first step (namely, opening the door of the refrigerator) and the last step (namely, closing the door of the refrigerator) during use of the refrigerator by a user are both closely related to the hinge.

However, in a process of frequently opening and closing the door of the refrigerator, stress surfaces are mainly located on a hinge hole of the door of the refrigerator. Use for a long time extremely easily cause damage to a joint between the door of the refrigerator and the hinge. When the damaged position is in contact with a heat insulation material of the door of the refrigerator, an entire door body may need to be replaced.

BRIEF SUMMARY OF THE INVENTION

An objective of embodiments of the present invention is to provide an improved refrigeration device.

Therefore, an embodiment of the present invention provides a refrigeration device. The refrigeration device includes: a main body; a first door, the first door being pivotably disposed on a front side of the main body, and the first door having an opening; a second door, the second door being pivotably disposed on a front side of the first door to open or close the opening; a first hinge member, the first hinge member including a first connection portion that is fixed on the main body and a first hinged portion that is connected to the first door; and a second hinge member, the second hinge member including a second connection portion that is fixed on the first door and a second hinged portion that is connected to the second door, the second hinge member further including a columnar portion, and the columnar portion being hinged to the first hinged portion, where one of the columnar portion and the first hinged portion has a first shaft hole, and the other of the columnar portion and the first hinged portion includes a first hinge shaft that extends into the first shaft hole.

Compared with the prior art, in the technical solution of this embodiment of the present invention, through mating between the first hinge member and the second hinge member, while the main body, the first door, and the second door are hinged to each other, the first door can be effectively prevented from being damaged because of being in direct contact with the first hinge member and increasing maintenance costs. In addition, if strength of a hinge member is higher than that of a top cover or an end cover, in contact with a heat insulation material, of a door of a refrigeration appliance, mating between the second hinge member and the first hinged portion that have higher strength is beneficial to avoiding a possibility of damage at a hinged position of the door of the refrigeration appliance due to, for example, bearing or collision, thereby increasing reliability of the refrigeration device according to this embodiment of the present invention. Further, the second hinged portion and the columnar portion matched with the first hinged portion are disposed on the second hinge member, which is beneficial to precisely positioning the first door and the second door, thereby improving assembly precision of the refrigeration appliance.

In one or more embodiments, the columnar portion may have the first shaft hole, the first shaft hole may be located in the first door, and the first hinged portion may include the first hinge shaft and extend into the columnar portion. This is beneficial to precisely positioning the first door. Further, in an embodiment of disposing the second hinge member on the bottom of the first door, stress surfaces may include the first shaft hole and the second hinge member on which the first shaft hole is located, so that a hinge hole on the first door that is for hinging to the first hinge member can be effectively prevented from being damaged due to excessive large borne stress.

In one or more embodiments, the first shaft hole may be a blind hole. This is beneficial to centralizing stress surfaces on the first shaft hole and the second hinge member on which the first shaft hole is located, thus preventing a door frame of the first door from being damaged because of being in direct contact with the first hinge member.

In one or more embodiments, the second hinge member may be fixed on the bottom of the first door, and the first door is supported on the first hinge member via the second hinge member. It is understood by a person skilled in the art that based on the design of this embodiment of the present invention, when the first hinge member supports the first door, a stress surface is the second hinge member, so that the door frame of the first door can be effectively prevented from being damaged because of being in direct contact with the first hinge member.

In one or more embodiments, the first door includes a lower door frame member, the lower door frame member may have a receiving hole recessed toward the interior of the first door, the columnar portion extends into the receiving hole, and there is an interval between an upper end of the columnar portion and a top wall of the receiving hole. This is beneficial to preventing an end wall of the receiving hole from bearing stress and being damaged because of being in direct contact with an end portion of the columnar portion.

In one or more embodiments, the second connection portion is board-shaped and connected to a bottom surface of the first door. This is beneficial to ensuring an aesthetic appearance of the refrigeration device while enlarging a stress surface of the second hinge member.

In one or more embodiments, the second hinge member may be fixed on the top of the first door. This is beneficial to positioning the first door and the second door above, and is beneficial to reducing a possibility of damage of an upper frame member of the first door as well.

In one or more embodiments, the columnar portion and the second connection portion may be integrally formed.

This is beneficial to positioning the first door and the second door, and is beneficial to improving entire firmness of the second hinge member, thus preventing the second hinge member from compressing and deforming and even breaking when the first hinge member supports the first door via the second hinge member.

In one or more embodiments, the second hinge member may further include an interval slot between the second hinged portion and the columnar portion, and the interval slot may be at least partially located between the first door and the second door. This is beneficial to precisely positioning a distance between the first door and the second door, and prevents a size chain from being excessively long caused by assembly of a plurality of parts.

In one or more embodiments, a side, which faces toward the first door, of the interval slot is open, to make it convenient to remove and assemble.

In one or more embodiments, the refrigeration device may include a shaft sleeve located within the first shaft hole. This is beneficial to preventing the first hinged portion from rotating relative to the columnar portion and wearing or making abnormal sound.

In one or more embodiments, the refrigeration device may include an adjustment member for adjusting the height of the first door relative to the main body, and the adjustment member is connected to the first hinged portion. This facilitates flexible adjustment of the height of the first door relative to the main body, and is conducive to precisely positioning a position of the first door relative to the main body and beneficial to assembly. The adjustment member may be located in the shaft sleeve.

In one or more alternative embodiments, the second hinged portion may include a second shaft hole, the second door may include a second hinge shaft, and the second hinge shaft is rotatably located in the second shaft hole. In this way, the second door can rotate around the second hinge shaft, to open or close the opening.

In one or more embodiments, the first door and the second door may be respectively provided with a slot body, and the slot bodies of the first door and the second door are spliced, that is connected, to form a space accommodating the second hinge member. In this way, when the second door closes the opening of the first door, the second hinge member may be at least partially hidden, thus being beneficial to optimizing entire beauty of the refrigeration device.

In one or more embodiments, a lower side of the second hinge member may be provided with a first stop portion, the first hinge member may be provided with a first limiting portion matched with the first stop portion, and when the first door rotates to a first preset angle, the first stop portion may be abutted against the first limiting portion. Continuous rotation of the first door or the first door and the second door after the first preset angle is limited to prevent damage of the door body caused by an excessively large rotation angle of the first door or the first door and the second door.

In one or more embodiments, the second hinge member may include a second limiting portion, the second door is provided with a second stop portion that is matched with the second limiting position, and when the second door rotates to a second preset angle, the second stop portion is abutted against the second limiting portion. Continuous rotation of the second door after the second preset angle is limited to prevent damage of the door body caused by an excessively large rotation angle of the second door.

An embodiment of the present invention further provides a refrigeration device. The refrigeration device includes: a main body; a first door, pivotably disposed on a front side of the main body; a first hinge member, including a first connection portion that is fixed on the main body and a first hinge shaft that is connected to the first door; and a connection member, including a second connection portion that is connected to the bottom of the first door and a columnar portion that extends into the first door, the first hinge shaft extending into the columnar portion, and the first door being supported on the first hinge member via the connection member.

Compared with the prior art, in the technical solution of this embodiment of the present invention, while the connection member hinges the main body to the first door, a lower frame member of the first door can be effectively prevented from being damaged because of being in direct contact with the first hinge member, thus improving reliability of a door of the refrigeration device.

Optionally, the refrigeration device may further include a second door, the second door being pivotably disposed on a front side of the first door; and the connection member is a second hinge member, the second hinge member including a second hinged portion hinged to the second door. It is understood by a person skilled in the art that based on the design of this embodiment of the present invention, when the first hinge member supports the first door, a stress surface includes the second hinge member, so that a hinge hole on the first door that is for hinging to the first hinge member can be effectively prevented from being damaged due to excessive large borne stress. Further, the connection member may further precisely position the first door and the second door, thus improving assembly precision of a door body.

Optionally, the first door may include a lower door frame member, the lower door frame member has a receiving hole recessed toward the interior of the first door, the columnar portion extends into the receiving hole, and there is an interval between an upper end of the columnar portion and a top wall of the receiving hole, to preventing the first door from being in direction contact with the columnar portion, and more effectively prevent a hinge hole on the first door that is for hinging to the first hinge member from being damaged due to excessive large borne stress.

The disclosure will become more fully understood from the detailed description given herein below for illustration only. The illustrated embodiments are exemplary only and should not be understood to limit the scope of the disclosure.

DETAILED DESCRIPTION OF THE INVENTION

Figure 1:
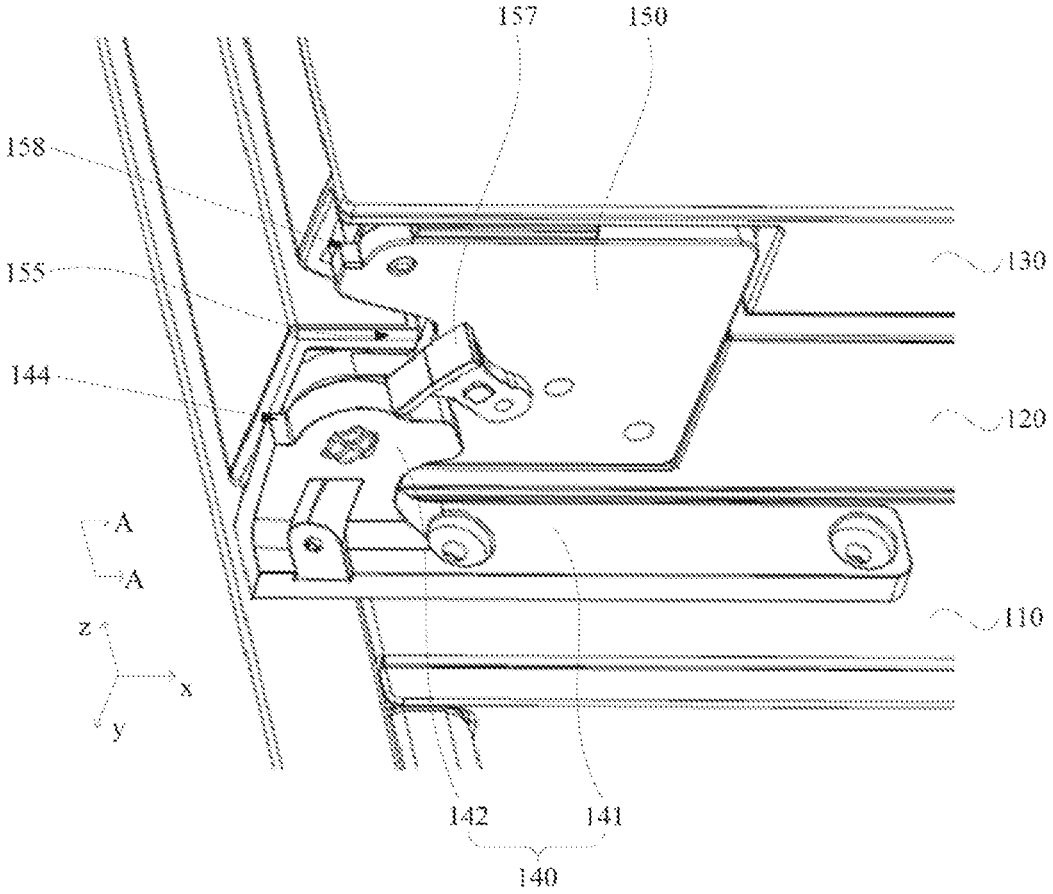
FIG. 1 is a schematic structural diagram of a hinge region of a refrigeration device according to an embodiment of the present invention.

Referring now to the figures of the drawing in detail, the following individual elements are illustrated and identified with the following reference numerals: 100 and 200: Refrigeration devices; 110: Main body; 111: Storage compartment; 120: First door; 121: Opening; 122: Lower door frame member; 123: Receiving hole; 123*a*: Top wall of the receiving hole; 125: Slot body; 130: Second door; 131: Second hinge shaft; 132: Door opener; 133: Fixing arm; 134: Second stop portion; 140: First hinge member; 141: First connection portion; 142: First hinged portion; 143: First hinge shaft; 144: First limiting portion; 150: Second hinge member; 151: Second connection portion; 152: Second hinged portion; 153: Columnar portion; 153*a*: Upper end of the columnar portion; 154: First shaft hole; 155: Interval slot; 156: Second shaft hole; 157: First stop portion; 158: Second limiting portion; 160: Shaft sleeve; 170: Adjustment member; 210: connection member; gap: Gap; x: Length direction of the refrigeration device; y: Width direction of the refrigeration device; and z: Height direction of the refrigeration device.

It is understood by a person skilled in the art that as described in the related art, a design of connection between a door body and a box body of an existing refrigeration device has a server defect that a position at which a door of a refrigerator is hinged to a box body is extremely easily damaged. Particularly, when the damaged position is in contact with a heat insulation material of the door of the refrigerator, an entire door body may need to be replaced.

To resolve the foregoing technical problem, an embodiment of the present invention provides a refrigeration device. The refrigeration device includes: a main body; a first door, the first door being pivotably disposed on a front side of the main body, and the first door having an opening; a second door, the second door being pivotably disposed on a front side of the first door to open or close the opening; a first hinge member, the first hinge member including a first connection portion that is fixed on the main body and a first hinged portion that is connected to the first door; and a second hinge member, the second hinge member including a second connection portion that is fixed on the first door and a second hinged portion that is connected to the second door, the second hinge member further including a columnar portion, and the columnar portion being hinged to the first hinged portion, where one of the columnar portion and the first hinged portion has a first shaft hole, and the other of the columnar portion and the first hinged portion includes a first hinge shaft that extends into the first shaft hole.

It is understood by a person skilled in the art that in the technical solution of this embodiment of the present invention, through mating between the first hinge member and the second hinge member, while the main body, the first door, and the second door are hinged to each other, the first door can be effectively prevented from being damaged because of being in direct contact with the first hinge member and increasing maintenance costs. In addition, if strength of a hinge member is higher than that of a top cover or an end cover, in contact with a heat insulation material, of a door of a refrigeration appliance, mating between the second hinge member and the first hinged portion that have higher strength is beneficial to avoiding a possibility of damage at a hinged position of the door of the refrigeration appliance due to, for example, bearing or collision, thereby increasing reliability of the refrigeration device according to this embodiment of the present invention.

Further, the second hinged portion and the columnar portion matched with the first hinged portion are disposed on the second hinge member, which is beneficial to precisely positioning the first door and the second door, thereby improving assembly precision of the refrigeration appliance.

To make the foregoing objectives, features, and advantages of the present invention more comprehensible, the following describes in detail the specific embodiments of the present invention with reference to the accompanying drawings.

FIG. 1 is a schematic structural diagram of a hinge region of a refrigeration device according to an embodiment of the present invention. The refrigeration device may include a refrigerator, a refrigerated cabinet, or the like. The hinge region refers to a position at which a door body of the refrigeration device is hinged to a box body.

Figure 2:
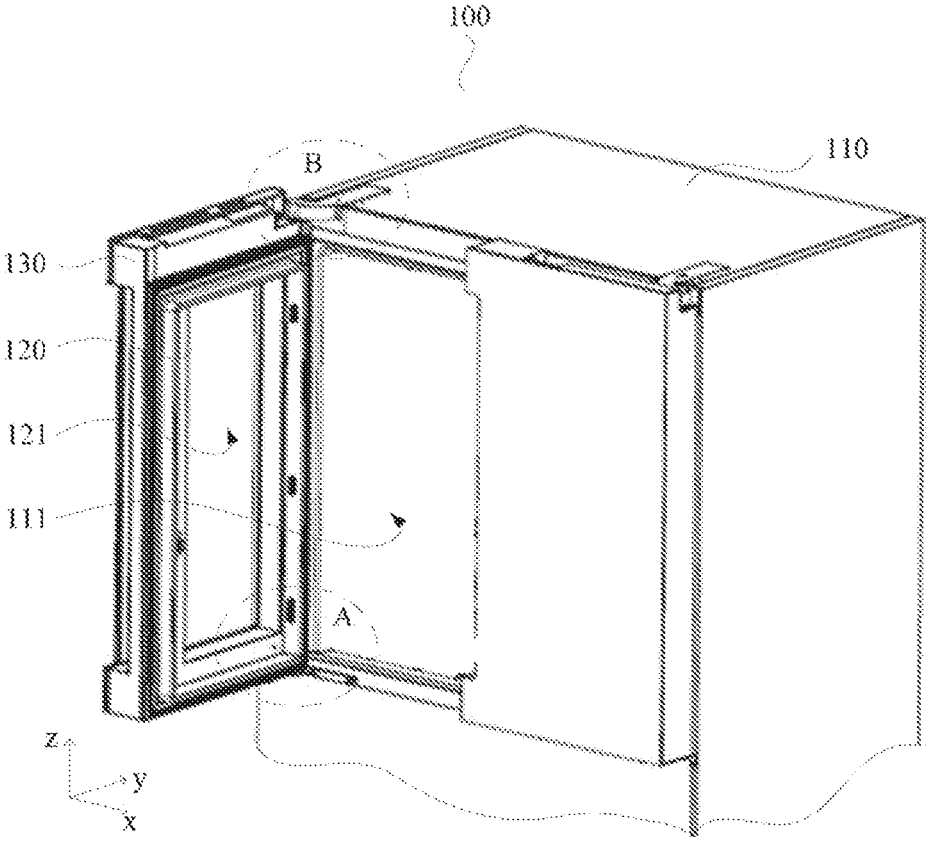
FIG. 2 is a schematic partial three-dimensional structural diagram of the refrigeration device in FIG. 1.

Specifically, in this embodiment, with reference to FIG. 1 and FIG. 2, the refrigeration device 100 may include: a main body 110; a first door 120, the first door 120 being pivotably disposed on a front side of the main body 110, and the first door 120 having an opening 121; and a second door 130, the second door 130 being pivotably disposed on a front side of the first door 120 to open or close the opening 121.

In one or more embodiments, the hinge region shown in FIG. 1 may correspond to a region A and/or a region B in FIG. 2.

For ease of description, in this embodiment, a length direction of the refrigeration device 100 is set to a direction x, a depth direction of the refrigeration device 100 is set to a direction y, and a height direction of the refrigeration device 100 is set to a direction z. Front sides of the main body 110 and the first door 120 may be a side facing a user during actual use. A storage space in the opening 121 or the main body 110 may be opened or closed by opening or closing the first door 120 and/or the second door 130.

A refrigerator is used as an example. Referring to FIG. 2, the main body 110 may be a box body of the refrigerator. The main body 110 includes at least one storage compartment 111. The first door 120 may be configured to uniformly open or close storage compartments 111. Openings 121 on the first door 120 may be in one-to-one correspondence with the storage compartments 111. Second doors 130 may be in one-to-one correspondence with the openings 121. Each second door 130 may be configured to open or close a corresponding opening 121. For example, the first door 120 may be an inner door of the refrigerator, and the second doors 130 may be outer doors of the refrigerator. When only the second doors 130 are opened, only one storage compartment 11 of the main body 110 may be exposed (or when the box body includes only one storage compartment 111, only a partial region of the storage compartment 111 may be exposed). When the first door 120 is opened, all the storage compartments 111 of the main body 110 may be exposed (or when the box body includes only one storage compartment 111, all regions of the storage compartment 111 are exposed). In actual application, a person skilled in the art may adjust, according to a requirement, a specific region of the first door 120 that can open or close the main body 110, and a specific shape and size of the opening 121 as well. Details are not described herein again.

Figure 3:
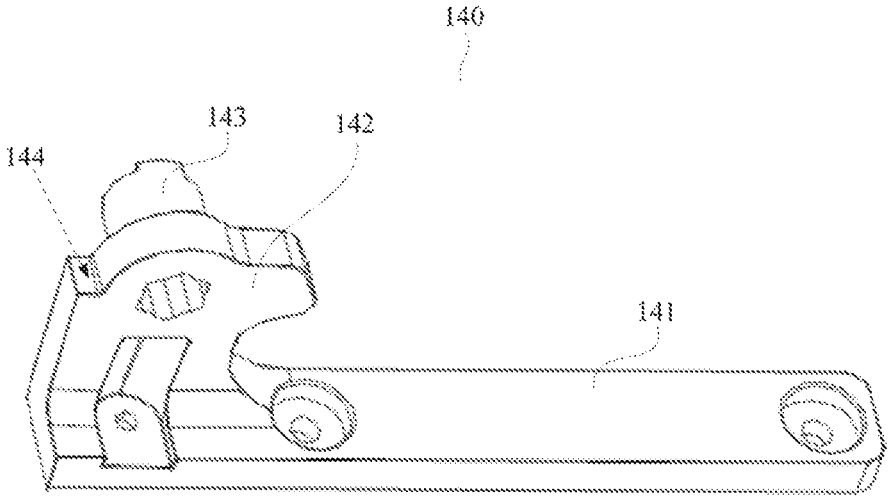
FIG. 3 is a schematic structural diagram of a first hinge member in FIG. 1.

More specifically, with reference to FIG. 1 and FIG. 3, the refrigeration device 100 may further include a first hinge member 140. The first hinge member 140 may include a first connection portion 141 that is fixed on the main body 110 and a first hinged portion 142 that is connected to the first door 120.

In a non-limiting embodiment, with reference to FIG. 1 to FIG. 3, the first door 120 may rotate around the first hinged portion 142 to open or close the storage compartment 111. The storage compartment 111 has an opening on the front side of the main body 110.

For example, the first connection portion 141 may be fixedly connected to the main body 110 through a bolt.

Figure 4:
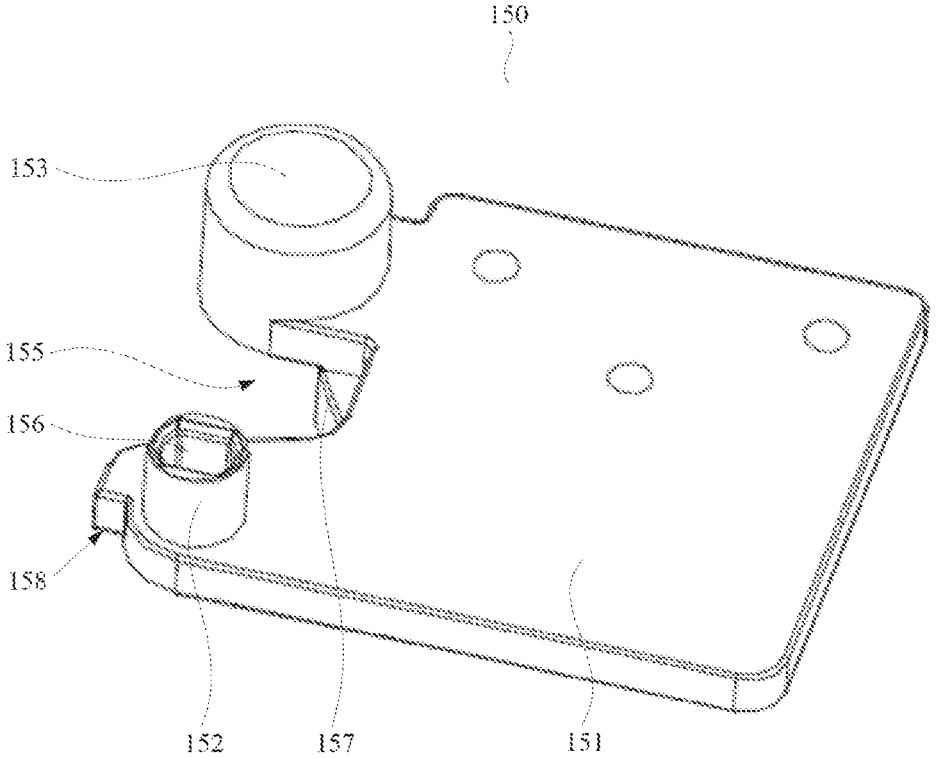
FIG. 4 is a schematic structural diagram of a second hinge member in FIG. 1.
Figure 5:
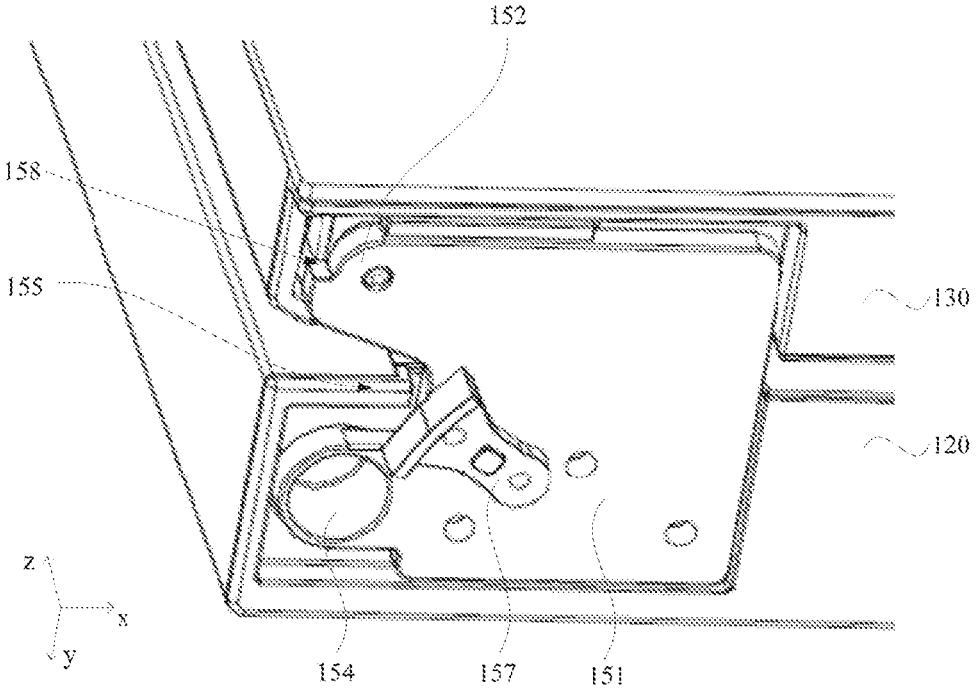
FIG. 5 is a schematic diagram of combination of the second hinge member in FIG. 1 and a first door and a second door.
Figure 6:
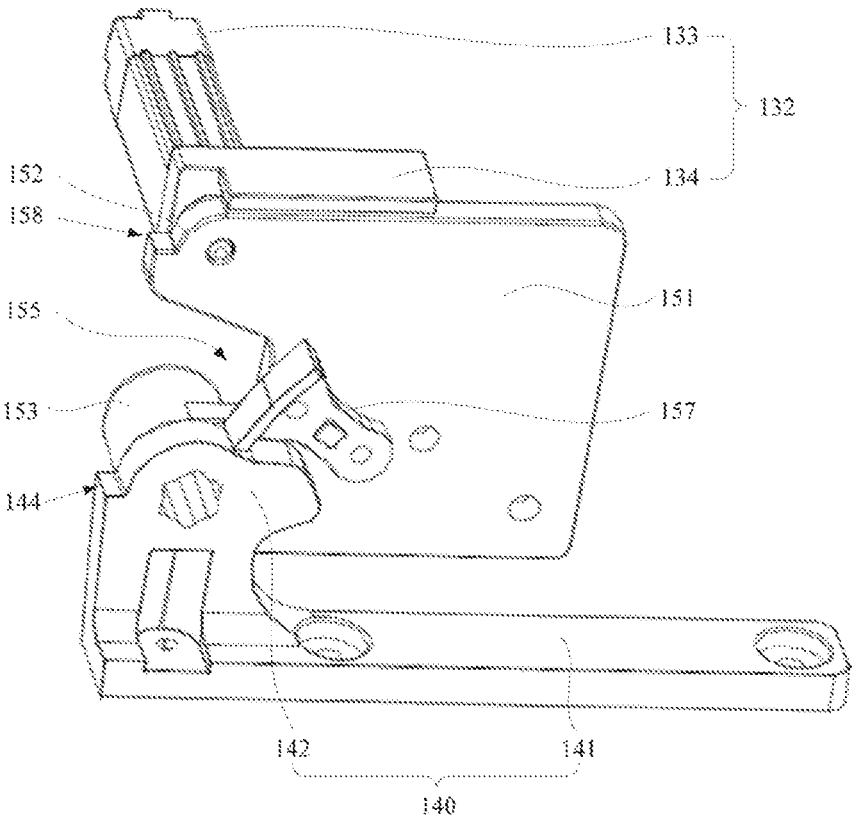
FIG. 6 and FIG. 7 are schematic diagrams of combination of hinged parts shown in FIG. 1 in different visual angles.
Figure 7:
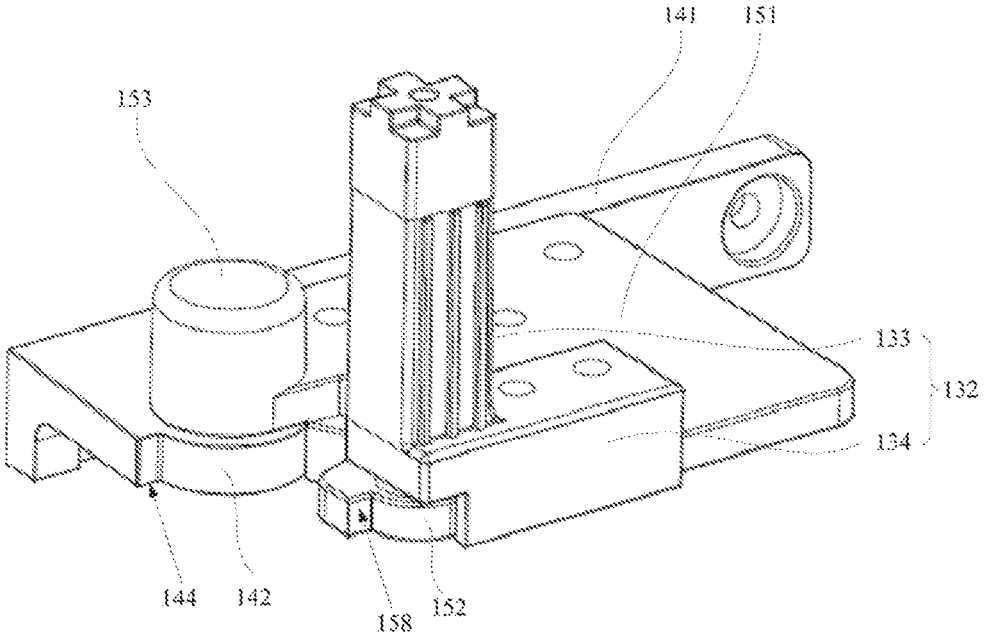

Further, with reference to FIG. 1, FIG. 4, and FIG. 5, the refrigeration device 100 may further include a second hinge member 150. The second hinge member 150 may include a second connection portion 151 that is fixed on the first door 120 and a second hinged portion 152 that is connected to the second door 130.

In a non-limiting embodiment, with reference to FIG. 1 to FIG. 5, the second door 130 may rotate around the second hinged portion 152, to open or close the opening 121 on the front side of the first door 120.

Further, with reference to FIG. 4 to FIG. 7, the second hinge member 150 may include a columnar portion 153. The columnar portion 153 is hinged to the first hinged portion 142. One of the columnar portion 153 and the first hinged portion 142 has a first shaft hole 154, and the other of the columnar portion 153 and the first hinged portion 142 may include a first hinge shaft 143 that extends into the first shaft hole 154.

It is understood by a person skilled in the art that in the technical solution of this embodiment, through mating between the first hinge member 140 and the second hinge member 150, while the main body 110, the first door 120, and the second door 130 are hinged to each other, the first door 120 can be effectively prevented from being damaged because of being in direct contact with the first hinge member 140 and increasing maintenance costs. In addition, if strength of a hinge member is higher than that of a door body of the refrigeration device 100 and that of a top cover or an end cover, in contact with a heat insulation material, of the door body, mating between the second hinge member 150 and the first hinged portion 142 that have higher strength is beneficial to avoiding a possibility of damage at a hinged position of the door body of the refrigeration device 100 due to, for example, bearing or collision, thereby increasing reliability of the refrigeration device 100 according to this embodiment. Further, the second hinged portion 152 and the columnar portion 153 matched with the first hinged portion 142 are disposed on the second hinge member 150, which is beneficial to precisely positioning the first door 120 and the second door 130, thereby improving assembly precision of the refrigeration device 100.

In one or more embodiments, with reference to FIG. 5 to FIG. 9, the columnar portion 153 may have the first shaft hole 154. The first shaft hole 154 may be located in the first door 120. The first hinged portion 142 may include the first hinge shaft 143 and extend into the columnar portion 153. This is beneficial to precisely positioning the first door 120. Further, in an embodiment of disposing the second hinge member 150 on the bottom of the first door 120, stress surfaces may include the first shaft hole 154 and the second hinge member 150 on which the first shaft hole 154 is located, so that a hinge hole (namely, a part on the first door 120 that is for accommodating the columnar portion 153) on the first door 120 that is for hinging to the first hinge member 140 can be effectively prevented from being damaged due to excessive large borne stress.

Preferably, the first shaft hole 154 may be a blind hole, to centralize stress surfaces on the first shaft hole 154 and the second hinge member 150 on which the first shaft hole 154 is located, thus effectively preventing the first door 120 from being damaged because of being in direct contact with the first hinge member 140.

In one or more embodiments, referring to FIG. 1 and FIG. 2 (FIG. 1 may be considered as a partial enlarged diagram of the region A in FIG. 2). The second hinge member 150 may be fixed on the bottom of the first door 120 (for example, a position of the region A in FIG. 2). The first door 120 may be supported on the first hinge member 140 via the second hinge member 150. It is understood by a person skilled in the art that based on the design of this embodiment, when the first hinge member 140 supports the first door 120, a stress surface is the second hinge member 150, so that the door frame of the first door 120 can be effectively prevented from being damaged because of being in direct contact with the first hinge member 140.

Figure 10:
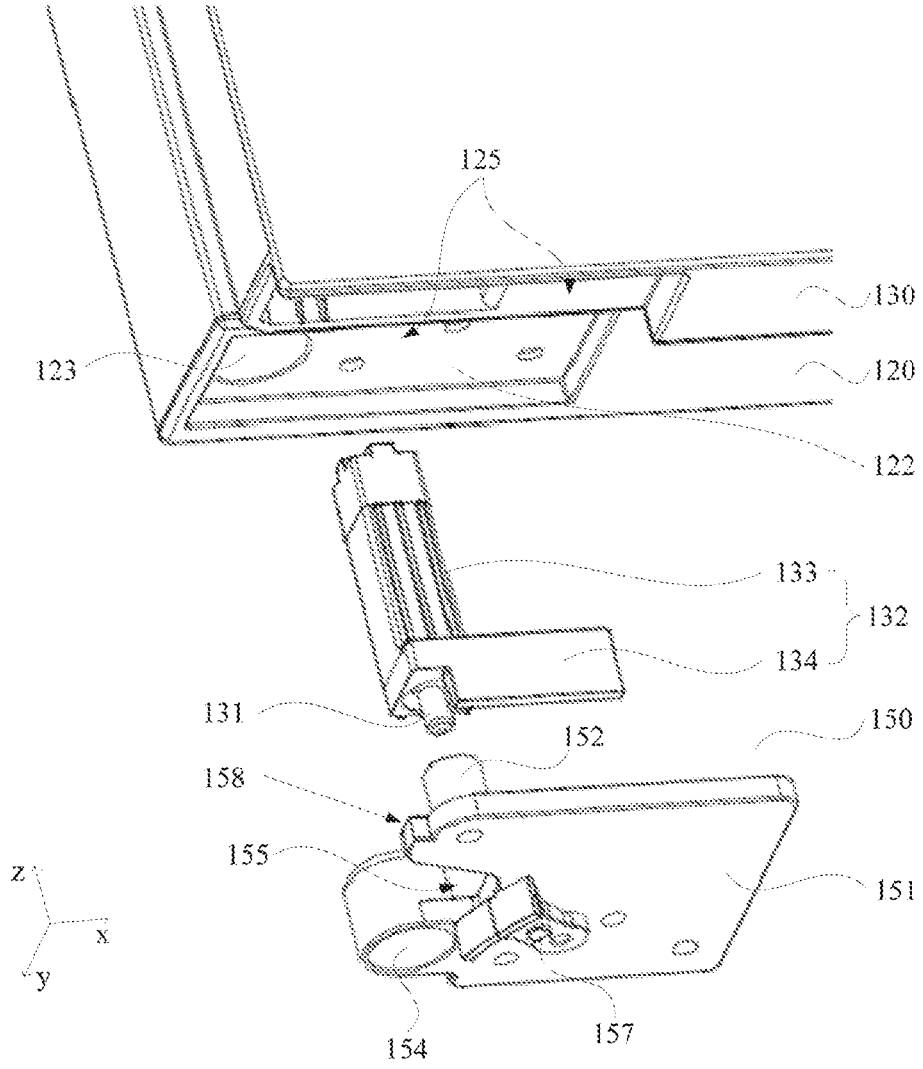
FIG. 10 is an exploded diagram of FIG. 5.
Figure 11:
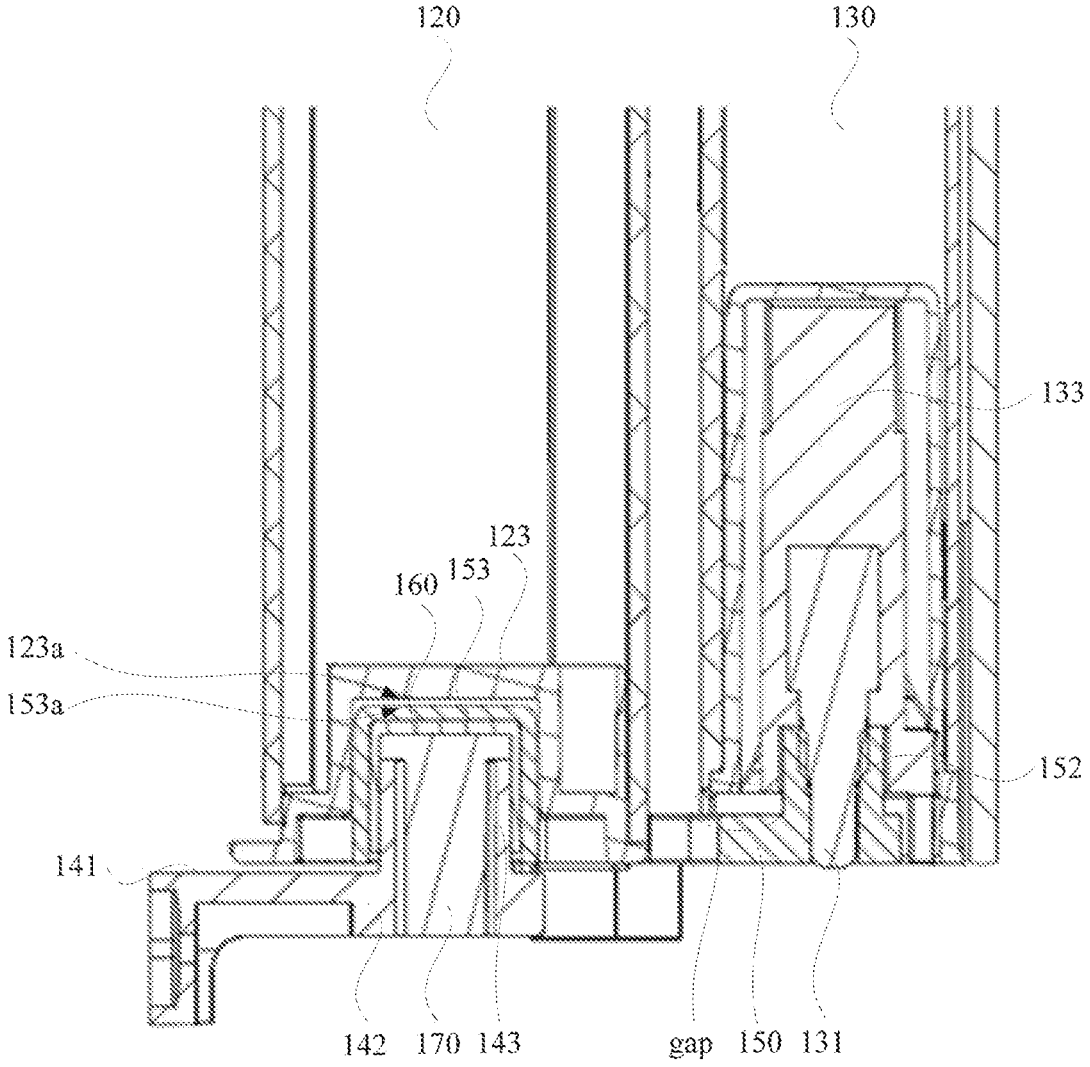
FIG. 11 is a sectional diagram of FIG. 1 along a direction AA.

In one or more embodiments, referring to FIG. 10 and FIG. 11, the first door 120 may include a lower door frame member 122. The lower door frame member 122 may have a receiving hole 123 recessed toward the interior of the first door 120. The columnar portion 153 may extend into the receiving hole 123. There is an interval between an upper end 153*a* of the columnar portion 153 and a top wall 123*a* of the receiving hole 123. This is beneficial to preventing an end wall of the receiving hole 123 from bearing stress and being damaged because of being in direct contact with an end portion of the columnar portion 153.

In a preferable example, sizes of the columnar portion 153 and the receiving hole 123 in an axial direction (parallel to the direction z) may be adjusted to form the interval between the upper end 153*a* of the columnar portion 153 and the top wall 123*a* of the receiving hole 123.

In one or more embodiments, the second connection portion 151 may be board-shaped and connected to a bottom surface of the first door 120. This is beneficial to ensuring an aesthetic appearance of the refrigeration device 100 while enlarging a stress surface of the second hinge member 150.

In one or more embodiments, the second hinge member 150 may further be fixed on the top of the first door 120 (for example, a position of the region B in FIG. 2). This is beneficial to positioning the first door 120 and the second door 130 above, and is beneficial to reducing a possibility of damage of an upper door frame member of the first door 120 as well.

In one or more embodiments, still referring to FIG. 4, the columnar portion 153 and the second connection portion 151 may be integrally formed. This is beneficial to positioning the first door 120 and the second door 130, and is beneficial to improving entire firmness of the second hinge member 150, thus preventing the second hinge member 150 from compressing and deforming and even breaking when the first hinge member 140 supports the first door 120 via the second hinge member 150.

Specifically, the second hinge member 150 is fixed on the bottom of the first door 120. The first hinge member 140 is matched with the second hinge member 150 when supporting the first door 120, thus preventing the first hinge member 140 from being directly abutted against a plastic door frame of the first door 120, thus being beneficial to preventing damage of a door frame member of the first door 120.

For example, the columnar portion 153 and the second connection portion 151 may be integrally formed through casting.

In one or more embodiments, the second hinged portion 152 may be integrally formed through casting with the columnar portion 153 and the second connection portion 151 as well.

In one or more embodiments, with reference to FIG. 1, and FIG. 4 to FIG. 10, the second hinge member 150 may further include an interval slot 155 between the second hinged portion 152 and the columnar portion 153, and the interval slot 155 may be at least partially located between the first door 120 and the second door 130. This is beneficial to precisely positioning a distance between the first door 120 and the second door 130, and prevents a size chain from being excessively long caused by assembly of a plurality parts.

In one or more embodiments, a side, which faces toward the first door 120, of the interval slot 155 is open, to make it convenient to remove and assemble. For example, an extension direction of the interval slot 155 may be parallel to a length direction of the first door 120 (to be specific, parallel to the direction x), and a direction of an opening of the interval slot 155 may be the same as a direction of opening the first door 120 and/or the second door 130.

Figure 8:
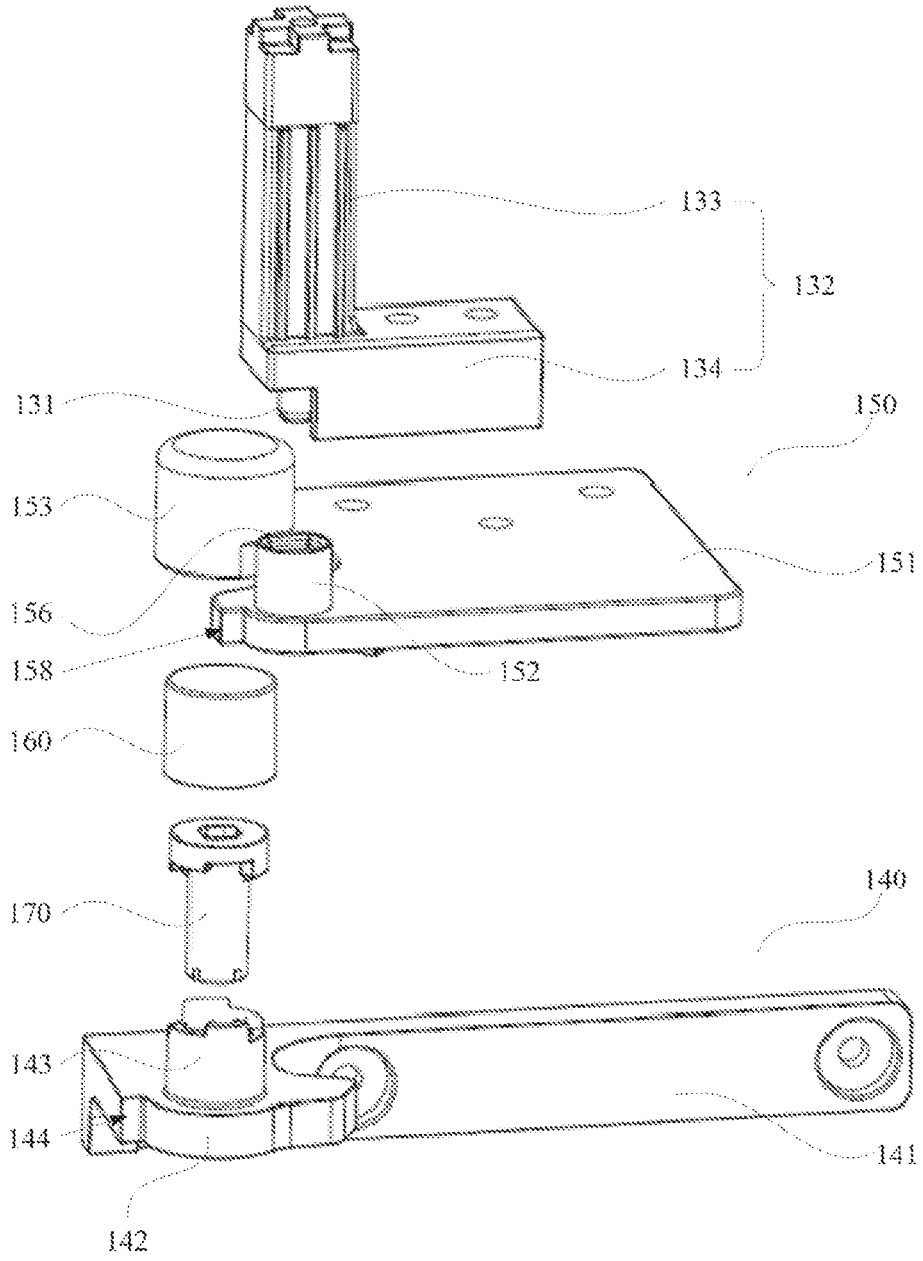
FIG. 8 and FIG. 9 are exploded diagrams of the hinged parts shown in FIG. 6 in different visual angles.
Figure 9:
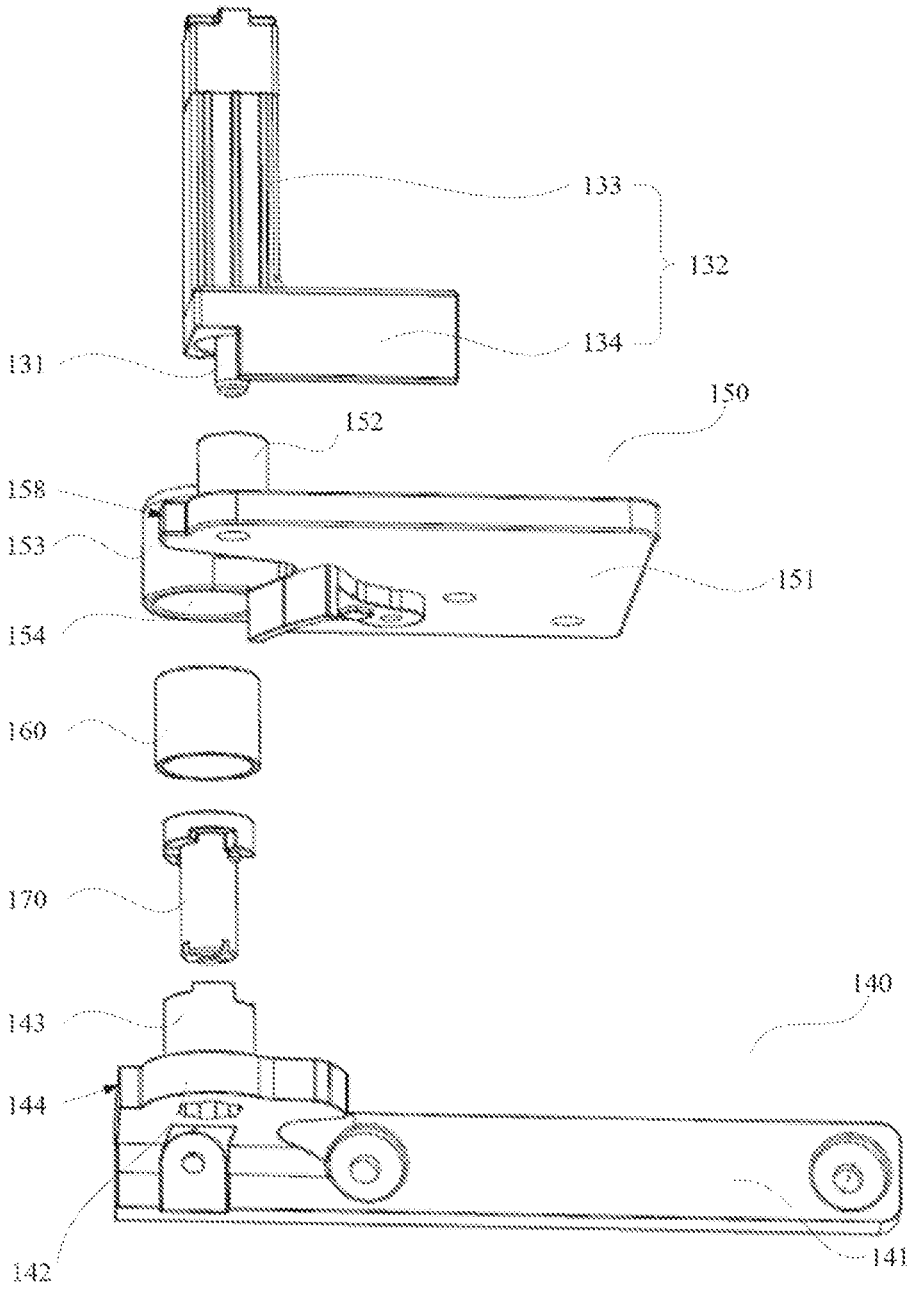

In one or more embodiments, referring to FIG. 8 and FIG. 9, the refrigeration device 100 may further include a shaft sleeve 160 located within the first shaft hole 154. This is beneficial to preventing the first hinged portion 142 from rotating relative to the columnar portion 153 and wearing or making abnormal sound.

In one or more embodiments, still referring to FIG. 8 and FIG. 9, the refrigeration device 100 may further include an adjustment member 170 for adjusting the height of the first door 120 relative to the main body 110. With reference to FIG. 11, the adjustment member 170 is connected to the first hinged portion 142. This facilitates flexible adjustment of the height of the first door 120 relative to the main body 110, and is conducive to precisely positioning a position of the first door 120 relative to the main body 110 and beneficial to assembly.

Preferably, the adjustment member 170 may be located in the shaft sleeve 160.

Specifically, a plurality of steps may be respectively disposed relatively on the adjustment member 170 and the first hinge shaft 143. Through pairing of steps on butting end surfaces of the adjustment member 170 and the first hinge shaft 143, a distance between the shaft sleeve 160 and the first hinged portion 142 can be adjusted in the direction z, thus adjusting a height position of the first door 120 relative to the main body 110 in the direction z.

For example, through pairing of the steps on the butting end surfaces of the adjustment member 170 and the first hinge shaft 143, the second hinge member 150 and the first door 120 may be raised along the direction z (or lowered along a reverse direction of the direction z), to ensure that the first door 120 can effectively close the storage compartment 111 of the main body 110.

In one or more alternative embodiments, referring to FIG. 4, FIG. 8, and FIG. 9, the second hinged portion 152 may include a second shaft hole 156. The second door 130 may include a second hinge shaft 131. The second hinge shaft 131 is rotatably located in the second shaft hole 156. In this way, the second door 130 can rotate around the second hinge shaft 131, to open or close the opening 121.

Specifically, the second hinge shaft 131 may be coupled to a door opener 132 installed in the second door 130, to reduce a quantity of parts, facilitate installation, and improve integration. The door opener 132 may include a fixing arm 133. A length direction of the fixing arm 133 is parallel to the direction z. The fixing arm 133 extends into the second door 130, so that connection between the second door 130 and the main body 110 is more stable.

In one or more embodiments, still referring to FIG. 1 and FIG. 10, the first door 120 and the second door 130 may be respectively provided with a slot body 125, and the slot bodies 125 of the first door 120 and the second door 130 are spliced, that is connected, to form a space accommodating the second hinge member 150. In this way, when the second door 130 closes the opening 121 of the first door 120, the second hinge member 150 may be at least partially hidden. To be specific, a plane formed by the second hinge member 150 in the direction x and the direction y and a lower surface of the first door 120 and the second door 130 are in a same plane, thus implementing a hidden design of the second hinge member 150, and being beneficial to optimizing entire beauty of the refrigeration device.

In a non-limiting embodiment, still referring to FIG. 11, there is a gap between top surfaces and/or bottom surfaces of the second hinge member 150 and the second door 130, to be beneficial to rotation of the second door 130 around the second hinge shaft 131.

Further, the second hinge member 150 is connected to a top surface and/or a bottom surface of the first door 120, to further disperse stress on the receiving hole 123 to the first door 120 via the second hinge member 150, to better prevent the first door 120 (for example, the plastic door frame of the first door 120) from being damaged.

In one or more embodiments, referring to FIG. 1, and FIG. 3 to FIG. 10, a lower side of the second hinge member 150 may be provided with a first stop portion 157, the first hinge member 140 is provided with a first limiting portion 144 matched with the first stop portion 157. The lower side of the second hinge member 150 is a side, in contact with the first hinge member 140, of the second hinge member 150 (namely, a side away from the first door 120 and the second door 130 in the direction z).

Figure 12:
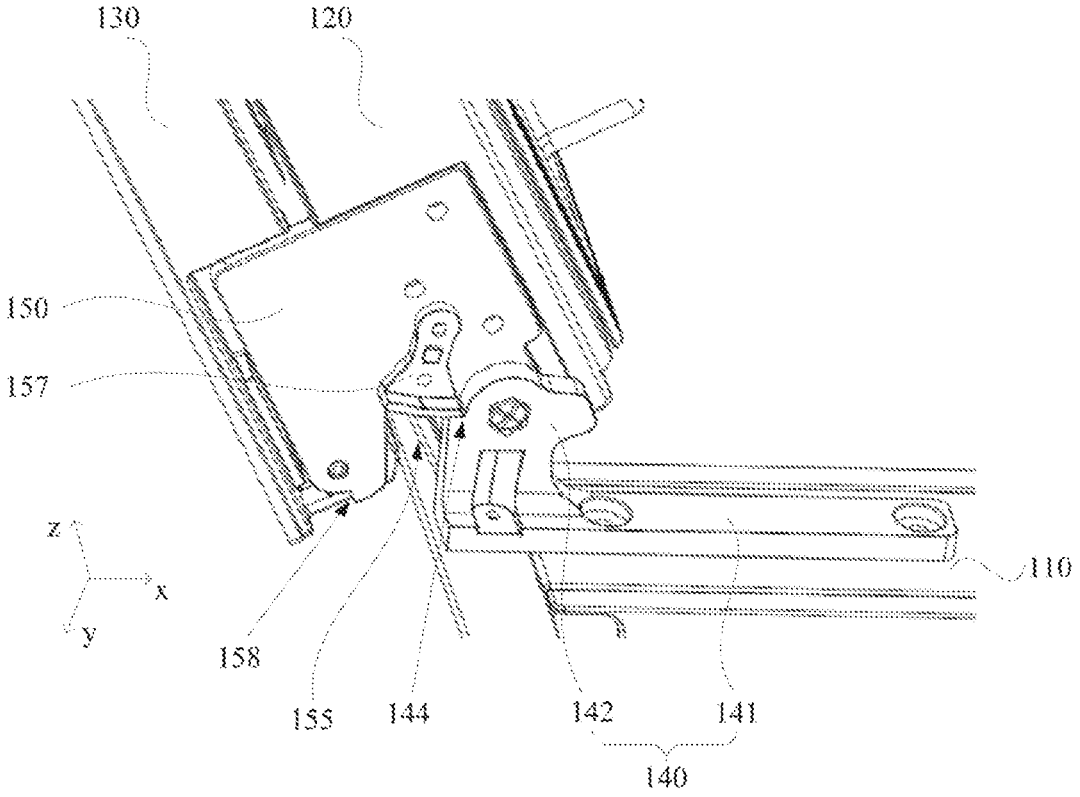
FIG. 12 is a schematic diagram of a first door and a second door that are in an open state in FIG. 1.

In a non-limiting embodiment, when the first door 120 rotates to a first preset angle (for example, rotates to a position shown in FIG. 12), the first stop portion 157 may be abutted against the first limiting portion 144. Continuous rotation of the first door 120 (or the first door 120 and the second door 130) after rotation to the first preset angle is limited, to prevent damage of the door body caused by an excessively large rotation angle of the first door 120 (or the first door 120 and the second door 130).

In one or more embodiments, the second door 130 and the first door 120 are pivotably disposed on the front side of the main body 110 by using hinged parts. The hinged parts may include the first hinge member 140, the second hinge member 150, and the door opener 132 fixed on the second door 130. Through mating between the first hinge member 140, the second hinge member 150, and the door opener 132, an opening and closing function of the first door 120 and/or the second door 130 is implemented.

Figure 13:
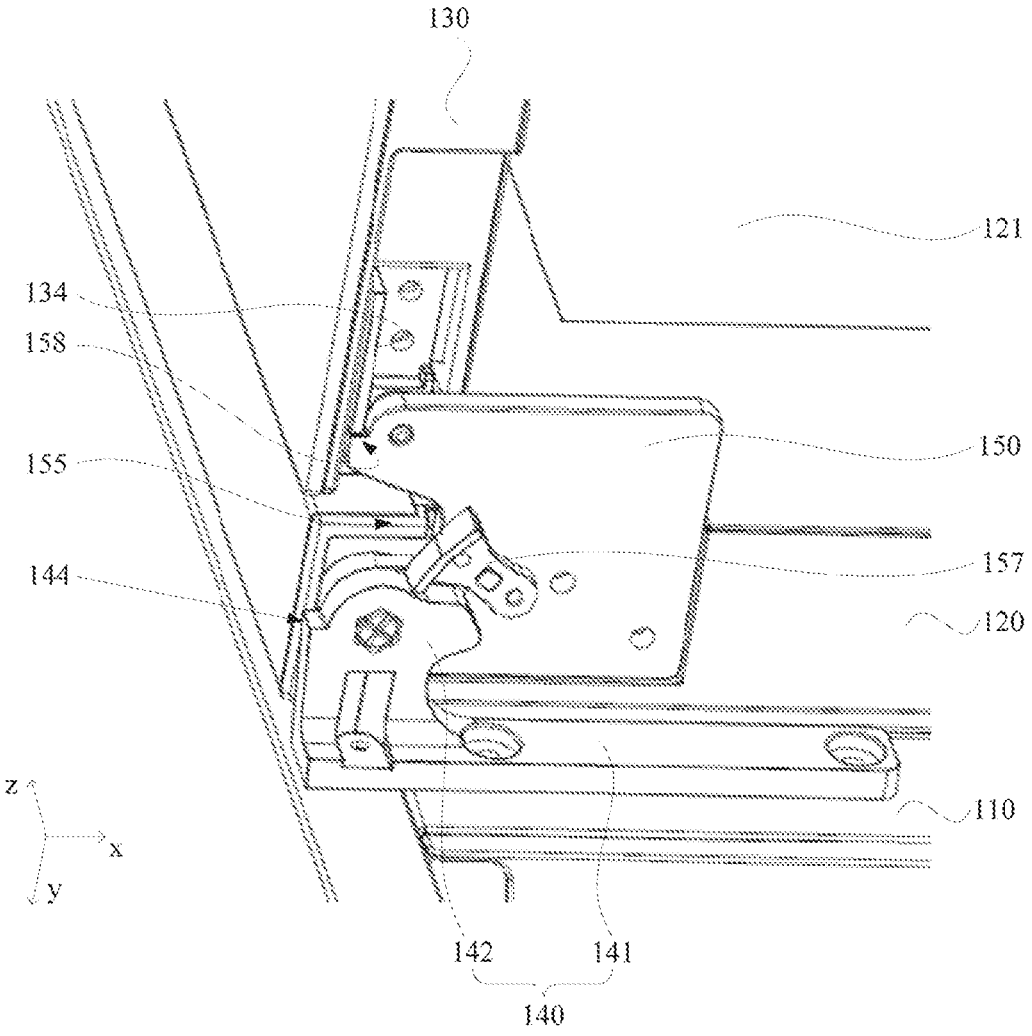
FIG. 13 is a schematic diagram of the second door in an open state in FIG. 1.

In one or more embodiments, referring to FIG. 6 to FIG. 9, the second hinge member 150 may include a second limiting portion 158, the second door 130 is provided with a second stop portion 134 that is matched with the second limiting position 158, and when the second door 130 rotates to a second preset angle (for example, rotates to a position shown in FIG. 13), the second stop portion 134 is abutted against the second limiting portion 158. Continuous rotation of the second door 130 after rotation to the second preset angle is limited, to prevent damage of the door body caused by an excessively large rotation angle of the second door 130.

Figure 14:
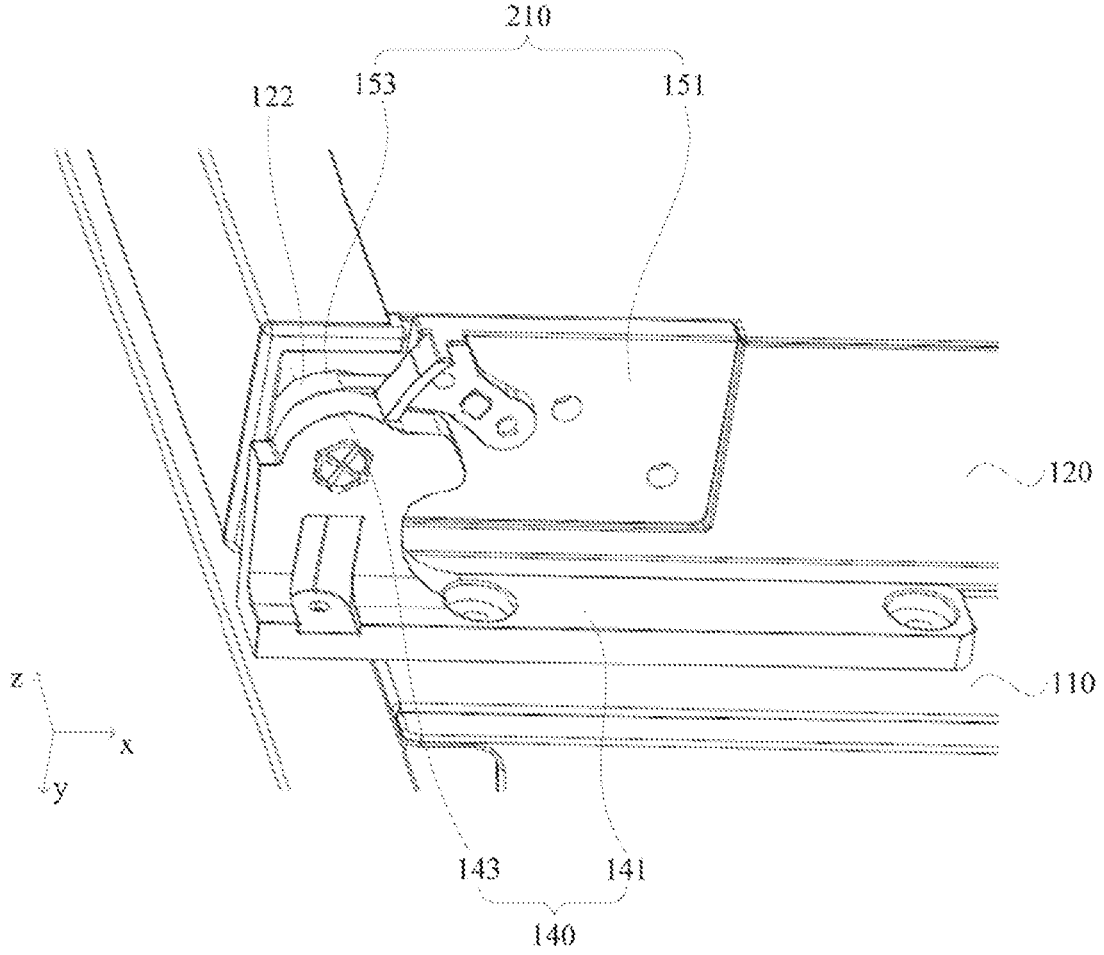
FIG. 14 is a schematic structural diagram of a hinge region of another refrigeration device according to an embodiment of the present invention.

FIG. 14 is a schematic structural diagram of a hinge region of another refrigeration device according to an embodiment of the present invention. Different from the refrigeration device 100 shown in FIG. 1 to FIG. 13, only one door body may be disposed on a front side of a main body 110 of the refrigeration device 200 in this embodiment.

Figure 15:
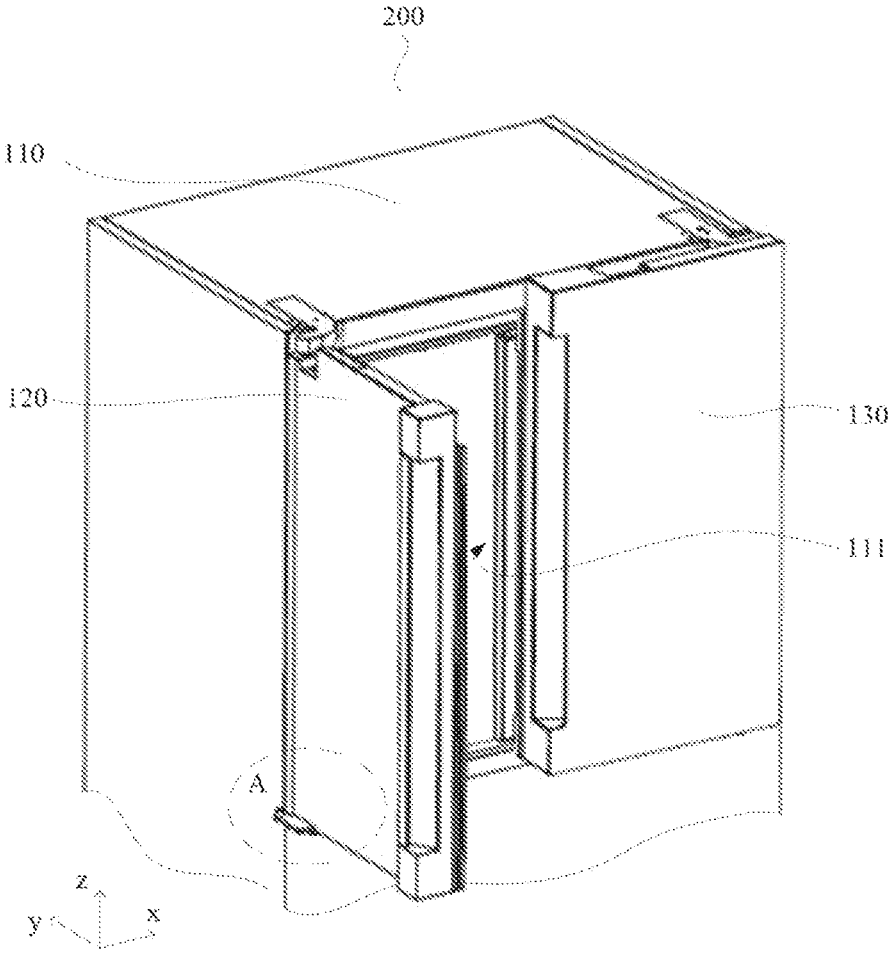
FIG. 15 is a schematic partial three-dimensional structural diagram of the refrigeration device in FIG. 14.

Specifically, with reference to FIG. 14 and FIG. 15, the refrigeration device 200 may include: a main body 110; a first door 120, the first door 120 being pivotably disposed on a front side of the main body 110; a first hinge member 140, including a first connection portion 141 that is fixed on the main body 110 and a first hinge shaft 143 that is connected to the first door 120; and a connection member 210, including a second connection portion 151 that is connected to the bottom of the first door 120 and a columnar portion 153 that extends into the first door 120, the first hinge shaft 143 extending into the columnar portion 153, and the first door 120 being supported on the first hinge member 140 via the connection member (210).

It is understood by a person skilled in the art that in the technical solution of this embodiment of the present invention, through the design of the connection member 210, while the main body 110 is hinged to the first door 120, a lower frame member (for example, a lower door frame member 122 shown in FIG. 1 to FIG. 13) of the first door 120 can be effectively prevented from being damaged because of being in direct contact with the first hinge member 140, thus improving reliability of a door (namely, the first door 120) of the refrigeration device 200.

In a non-limiting embodiment, the refrigeration device 200 may include a second door 130 as well, and the second door 130 is pivotably disposed on a front side of the first door 120, to form the refrigeration device 100 shown in FIG. 1 to FIG. 13.

Further, the connection member 210 may be the second hinge member 150 in FIG. 1 to FIG. 13. The second hinge member 150 includes the second hinged portion 152 hinged to the second door 130. It is understood by a person skilled in the art that based on the design of this embodiment of the present invention, when the first hinge member 140 supports the first door 120, a stress surface includes the second hinge member 150 (namely, the connection member 210), so that a hinge hole (namely, the receiving hole 123 in FIG. 1 to FIG. 13) on the first door 120 that is for hinging to the first hinge member 140 can be effectively prevented from being damaged due to excessive large borne stress. Further, the connection member 210 may further precisely position the first door 120 and the second door 130, thus improving assembly precision of a door body.

Further, with reference to FIG. 1 to FIG. 15, the first door 120 may include a lower door frame member 122, the lower door frame member 122 may have a receiving hole 123 recessed toward the interior of the first door 120, the columnar portion 153 extends into the receiving hole 123, and there is an interval between an upper end 153*a* of the columnar portion 153 and a top wall 123*a* of the receiving hole 123, to prevent the first door 120 from being in direct contact with the columnar portion 153, and more effectively prevent the hinge hole on the first door 120 that is for hinging to the first hinge member 140 from being damaged due to excessive large borne stress.

More specifically, for explanations of the nouns in the embodiments, reference may be made to related descriptions in FIG. 1 to FIG. 13. Details are not described herein again. The present invention is disclosed as above, but the present invention is not limited thereto. Any person skilled in the art may vary or modify the present invention, without departing from the spirit or scope of the present invention. Therefore, the protection scope of the present invention is defined by the claims.

The invention claimed is:

1. A refrigeration device, comprising:

a main body;

a first door pivotably mounted on a front side of the main body, the first door having an opening;

a second door pivotably mounted on a front side of the first door and configured to selectively open and close the opening;

a first hinge member having a first connection portion that is fixed on the main body and a first hinged portion that is connected to the first door;

a second hinge member having a second connection portion that is fixed on the first door, a second hinged portion that is connected to the second door, and a columnar portion that is hinged to the first hinged portion, and wherein one of the columnar portion and the first hinged portion is formed with a first shaft hole, and the other of the columnar portion and the first hinged portion includes a first hinge shaft that extends into the first shaft hole; and a shaft sleeve located within the first shaft hole and an adjustment member for adjusting a height of the first door relative to the main body, the adjustment member being connected to the first hinged portion and located in the shaft sleeve.

2. The refrigeration device according to claim 1, wherein the columnar portion has the first shaft hole, the first shaft hole is located in the first door, and the first hinged portion comprises the first hinge shaft and extends into the columnar portion.

3. The refrigeration device according to claim 1, wherein the first shaft hole is a blind hole.

4. The refrigeration device according to claim 1, wherein the second hinge member is fixed on the bottom of the first door, and the first door is supported on the first hinge member via the second hinge member.

5. The refrigeration device according to claim 1, wherein the first door comprises a lower door frame member, the lower door frame member has a receiving hole recessed toward the interior of the first door, the columnar portion extends into the receiving hole, and there is an interval between an upper end of the columnar portion and a top wall of the receiving hole.

6. The refrigeration device according to claim 1, wherein the second connection portion is board-shaped and connected to a bottom surface of the first door.

7. The refrigeration device according to claim 1, wherein the second hinge member is fixed on the top of the first door.

8. The refrigeration device according to claim 1, wherein the columnar portion and the second connection portion are integrally formed.

9. The refrigeration device according to claim 1, wherein the second hinge member further comprises an interval slot between the second hinged portion and the columnar portion, and the interval slot is at least partially located between the first door and the second door.

10. The refrigeration device according to claim 9, wherein a side of the interval slot that faces toward the first door is open.

11. The refrigeration device according to claim 1, wherein the second hinged portion is formed with a second shaft hole, the second door comprises a second hinge shaft, and the second hinge shaft is rotatably located in the second shaft hole.

12. The refrigeration device according to claim 1, wherein the first door and the second door are respectively provided with a slot body, and the slot bodies of the first door and the second door are spliced to form a space accommodating the second hinge member.

13. The refrigeration device according to claim 1, wherein a lower side of the second hinge member is provided with a first stop portion, the first hinge member is provided with a first limiting portion matched with the first stop portion, and when the first door rotates to a first preset angle, the first stop portion abuts against the first limiting portion to limit a continuous rotation of the first door or the first door and the second door.

14. The refrigeration device according to claim 1, wherein the second hinge member comprises a second limiting portion, the second door is provided with a second stop portion that is matched with the second limiting position, and when the second door rotates to a second preset angle, the second stop portion is abutted against the second limiting portion to limit continuous rotation of the second door.

15. A refrigeration device, comprising:

a main body;

a first door pivotably mounted to a front side of the main body;

a first hinge member having a first connection portion that is fixed on the main body and a first hinge shaft that is connected to the first door; and a connection member having a second connection portion that is connected to the bottom of the first door and a columnar portion that extends into the first door, the first hinge shaft extending into the columnar portion, and the first door being supported on the first hinge member via the connection member; and a shaft sleeve located within a shaft hole formed in the columnar portion and an adjustment member for adjusting a height of the first door relative to the main body, the adjustment member being connected to the first hinge member and located in the shaft sleeve.

16. The refrigeration device according to claim 15, further comprising a second door, the second door being pivotably mounted on a front side of the first door; and the connection member being a second hinge member with a second hinged portion hinged to the second door.

17. The refrigeration device according to claim 15, wherein the first door comprises a lower door frame member formed with a receiving hole that is recessed toward an interior of the first door, the columnar portion extends into the receiving hole, and wherein an interval is formed between an upper end of the columnar portion and a top wall of the receiving hole.

* * * * *